United States Patent [19]

Lonnoy et al.

[11] Patent Number: 4,565,339

[45] Date of Patent: Jan. 21, 1986

[54] SYSTEM FOR GUIDING A MISSILE BY A FLAT LIGHT PENCIL BEAM

[75] Inventors: Jacques J. Lonnoy, Paris; Roland Mousson, Soisy sur Seine, both of France

[73] Assignee: Societe Anonyme de Telecommunications, France

[21] Appl. No.: 571,583

[22] Filed: Jan. 17, 1984

[30] Foreign Application Priority Data

Jan. 20, 1983 [FR] France ..... 83 00838

[51] Int. Cl.[4] ..... F41G 7/26

[52] U.S. Cl. ..... 244/3.13

[58] Field of Search ..... 244/3.13

[56] References Cited

U.S. PATENT DOCUMENTS

| | | | |
|---|---|---|---|
| 3,398,918 | 8/1968 | Girault | 244/3.13 |
| 3,614,025 | 10/1971 | Maillet | 244/3.13 |
| 3,782,667 | 1/1974 | Miller, Jr. et al. . | |
| 4,020,339 | 4/1977 | Gustafson | 244/3.13 |
| 4,243,187 | 1/1981 | Esker . | |
| 4,408,734 | 10/1983 | Koreicho | 244/3.13 |
| 4,424,944 | 1/1984 | Wes et al. | 244/3.13 |

FOREIGN PATENT DOCUMENTS

| | | |
|---|---|---|
| 2164180 | 7/1973 | France . |
| 1512405 | 6/1978 | United Kingdom . |
| 1512406 | 6/1978 | United Kingdom . |

*Primary Examiner*—Charles T. Jordan

*Attorney, Agent, or Firm*—Jacobs & Jacobs

[57] ABSTRACT

The system is intended to determine the angular deviation of the missile to direct it into a target. It comprises a laser, a rotating convergent cylindrical lens to convert the laser beam into a flat, elongated, rotating pencil beam. The missile bears one detector scanned by the pencil beam and processing circuits for determining the polar coordinates of the missile and for controlling its rudders.

2 Claims, 4 Drawing Figures

SYSTEM FOR GUIDING A MISSILE BY A FLAT LIGHT PENCIL BEAM

BACKGROUND OF THE INVENTION

The present invention relates to a system for guiding a missile in a direction of sight, comprising a source of emission producing a light beam of which the axis corresponds to the direction of sight, means for analyzing the field of observation, adapted to convert the beam emitted by the source into at least one flat, elongated pencil beam and to displace the pencil beam, and, on the missile, a detector and processing means for determining, from the output signal of the detector, at least one deviation coordinate of the missile with respect to the direction of sight, and to be able to control the rudders of the missile in order to control its path on the direction of sight.

French Pat. No. 2 164 180 discloses such a guiding system. With this known system, guiding is effected from a single light pencil beam, but the missile bears four ADM detectors disposed on a circumference of the missile, at an equal angular distance from one another. This system presents drawbacks. Firstly, the presence of these four detectors gives the solution offered by the system a certain character of heaviness which prevents it from being adapted to missiles of small dimensions. Furthermore, such a system is, by nature, sensitive to the rolling motion.

It is an object of the present invention to propose a new system which overcomes the drawbacks of the known system.

SUMMARY OF THE INVENTION

To this end, the present invention relates to a system of the type mentioned above, characterized in that said processing means are adapted to determine the polar coordinates ($\rho$, $\theta$) of the missile with respect to an axis of reference having an origin located on the axis of the pencil beam.

In a preferred embodiment of the system of the invention, the pencil beam has a width $\epsilon$ and is driven in rotation at a speed $\omega$ about an axis merged with the direction of sight, to pass on the detector in time $\tau$, said processing means are adapted to determine the metric coordinate $\rho$ as a function of the speed of rotation $\omega$, the width $\epsilon$ and the time of passage $\tau$, and the angular coordinate $\theta$ as a function of the time $\tau$ taken by the pencil beam during its rotation, to reach the missile.

In this case, the system of the invention comprises, respectively associated with the source of emission and with the detector of the missile, two master clocks maintained in synchronism.

A meter is advantageously connected to the master clock associated with the detector to measure, upon each revolution, the time lapse between the instant of passage of the pencil beam through a reference position and the instant of passage on the detector.

BRIEF DESCRIPTION OF THE DRAWINGS

The invention will be more readily understood on reading the following description with reference to the accompanying drawings, in which.

DETAILED DESCRIPTION OF A PREFERRED EMBODIMENT

Figure 1:
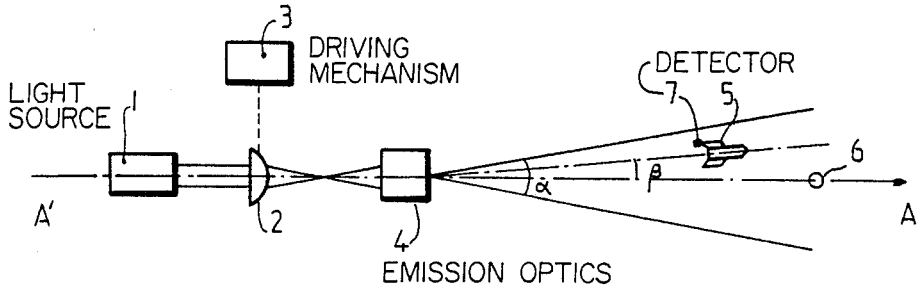
FIG. 1 schematically shows the emission part of the system.

Referring now to the drawings, the guiding system, whose emission part is schematically shown in FIG. 1, comprises a light source 1, in the present case a laser source emitting in the infrared, such as a $CO_2$ laser. A continuous emission laser may be used in the invention, but a pulsed emission laser is preferred, modulated to a recurrence period TR. However, it may also be envisaged to use other sources, such as an electroluminescent diode of the $A_5Ga$ type for example.

The beam emitted by the laser source 1 is modulated in amplitude, in known manner.

The beam leaving the modulator of the laser 1 is converted into a flat, elongated pencil beam by an optical system incorporating a convergent cylindrical lens 2, driven in uniform circular rotation at an angular speed $\omega$, by a barrel element 3 of a driving mechanism, which will be referred to again hereinafter, to create the sweep for analysis of the field of observation.

The resultant pencil beam then passes through emission optics 4, projecting into space the band produced by the lens 2 and disposed at the focus of these optics 4.

The missile 5 moves in an observation space of solid angle $\alpha$, directed towards a target 6 at which the pencil beam is aimed. The missile 5 bears a detector 7, sensitive to the wave length of the laser beam, which converts the light radiation which it receives into an electric output signal enabling the deviation coordinates of the detector 7 with respect to the axis of the pencil beam to be determined.

Signals representative of these coordinates are applied to the circuit for controlling rudders provided on the missile, so as to control the path of the missile 5 on the axis of the pencil beam and therefore on the target 6.

FIG. 1 does not show the visible path defining the direction of sight. It comprises, in known manner, a glass, and it is harmonized with the axis of the infrared source by an outside apparatus well known to one skilled in the art.

Before continuing the description of the structure of the guiding system, it is preferable to describe its working principle and the manner of obtaining the angular deviation measurements.

Figure 2:
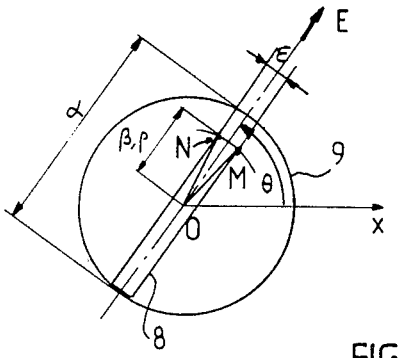
FIG. 2 schematically shows the sweep of the analyzing pencil beam of the system of FIG. 1, in the plane of the missile to be guided, perpendicular to the axis of sight.

FIG. 2 shows the sweep of the flat, elongated light pencil beam at a given instant in the plane of the missile 5 perpendicular to the axis of sight A'A which is at the same time the axis of rotation of the pencil beam which rotates with the optics 2.

The sweep of the pencil beam in this plane is substantially a very elongated, very fine rectangle 8 of angular length $\alpha$ and of angular width equal to the resolution $\epsilon$ depending on the quality of the optics of conversion 2 and of emission optics 4. The part inside the circle 9 in which the sweep of the pencil beam is inscribed represents the field of observation. O is the sweep of the axis of sight in the plane of FIG. 2.

Let $\rho$ and $\theta$ be the polar coordinates of the missile 5 with respect to a reference axis OX, perpendicular in O to the plane of FIG. 1, for example, the missile 5 being located on axis OE.

$\theta = (Ox, OE)$

As to the metric coordinate $\rho$, distance of the missile 5 to axis A'OA, it corresponds to the angular coordinate $\beta$(FIG. 1).

Let $\tau$ be the time of passage of the pencil beam on the detector 7 borne by the missile 5.

If the triangle OMN of FIG. 2 is considered, MN representing the segment of path of the detector 7 through the pencil beam, when the latter is considered fixed and the detector mobile, which is the opposite to reality but amounts to the same as far as the calculations are concerned, the length MN being equal to $\epsilon$ and being seen from O at an angle $\omega\tau$, the following may be written:

$$\frac{\frac{MN}{2}}{OM} = \sin\frac{\omega\tau}{2}$$

$$\frac{\frac{\epsilon}{2}}{\beta} = \sin\frac{\omega\tau}{2}$$

$$\beta = \frac{\epsilon}{2}\,\frac{1}{\sin\frac{\omega\tau}{2}}$$

Knowing the speed of rotation $\omega$ of the pencil beam, the time of passage $\tau$ of the pencil beam on the detector and $\epsilon$ also being known, the deviation coordinate $\beta$ is therefore deduced therefrom.

In the case of a pulsed laser, modulated to a recurrence period $T_R$, it is the number N of pulses received by the detector, equal to $$\frac{\tau}{T_R},$$

which makes it possible to obtain the coordinate $\beta$, according to the relation:

$$\beta = \frac{\epsilon}{2}\,\frac{1}{\sin\frac{\omega N T_R}{2}}$$

$T_B$ being the period of sweep of the pencil beam, the following may be written:

$$\omega = \frac{2\pi}{T_B}$$

Consequently, $$\beta = \frac{\epsilon}{2}\,\frac{1}{\sin \pi\frac{N T_R}{T_B}}$$

As to the deviation coordinate $\theta$, it is given by the formula:

$$\theta = \omega t - 2K\pi, \text{ or}$$

$$\theta = \frac{2\pi}{T_B}\,t - 2K\pi,$$

t corresponding to the time taken by the pencil beam to reach the missile 5, in M, after K revolutions ($2K\pi$). Therefore by having one master clock in association with the emitter source and another in association with the detector, set at zero at the departure of the missile and maintained in synchronism during flight, for example at every passage of the pencil beam through a horizontal position (Ox), and with the aid of synchronization pips emitted by the laser, the deviation coordinate $\theta$ may be deduced from t.

The generation of the synchronization pips by the laser is effected by conventional means, for example by variation of voltage, variation in length of the cavity, by displacement of a mirror of the laser.

It will be noted that the flat pencil beam, upon each of its revolutions, enables two angular deviation measurements to be elaborated.

It will also be noted that a rotatable mask provided with an appropriate slot could have been disposed in place of the optics 2. However, in that case, the concentration of energy would have been wanting.

The principle of elaborating angular deviation measurements with reference to one single flat pencil beam has just been described.

The calculations would be of the same nature if the guiding system no longer used a single pencil beam for analyzing the field, but for example two pencil beams.

These two pencil beams might moreover be emitted from the same source. To this end, a semi-transparent blade might be disposed on the path of the beam produced by the laser source, which blade would be traversed by part of the incident beam and on which the other part would be reflected. And from these two beams, it would be easy to produce two flat and elongated pencil beams, each obtained in the same manner as before, and it would then suffice to position one with respect to the other by conventional means.

To obtain two flat, elongated pencil beams in cross form from the same source, the beam issuing from the source might be passed through a complex lens composed of four parts, each occupying a quadrant of the complex lens, the lens of the first quadrant producing a first flat, elongated pencil beam, for example horizontal, like the lens of the third quadrant, but symmetrical with the first with respect to the centre of the complex lens, and the lens of the second quadrant producing a flat, elongated pencil beam which is vertical, like the lens of the fourth quadrant, but symmetrical with the second with respect to the centre of the complex lens.

These two flat, elongated pencil beams may be at right angles to each other, which is preferable, or not. They may be mounted to move in rotation about a common central axis or about an eccentric axis. They may be mounted to move in circular translation. They may further be mounted to move in rectilinear translation. In brief, any arrangement of a plurality of pencil beams animated by a scanning movement determining the angular deviation of the missile with respect to the direction of sight, once or several times per scanning period, may be envisaged.

It is easy to ascertain that, for a given metric resolution, a temporal resolution must be ensured which is the higher as the missile moves away the centre of the field and as, for a given angular coordinate $\beta$, the temporal resolution to be ensured increases with the distance. It is therefore the resolution corresponding to the edge of the observation field and at the limit of range which is to be taken into account. By way of example, a temporal resolution of 100 $\mu$s must correspond to a metric resolution of $\pm$20 cm at the edge of a field of $\pm$mrd at 2500 m.

To maintain such a temporal resolution for 10 s for example, requires for the clocks of the emitter and of the receiver a stability of $5.10^{-6}$. Such a requirement may be satisfied by solutions within the scope of one skilled in the art.

To return to the description of the structure of the system, the following precisions must be given.

At emission, i.e. at the level of the infrared source, there is provided a source of supply of the laser, a time base and electronic circuits for synchronization of the supply, for synchronization of the time base of the receiver borne by the missile before its expulsion, for generation of the modulation frequency of the laser, for servocontrol of the rotation of the cylindrical optics 2. It is unnecessary to describe these electronic means in greater detail as they are well known to one skilled in the art. However, it will be specified that, in the embodiment described, the cylindrical optical system 2 is mounted on a barrel element 3 driven by a motor and which bears an incremental optical disc associated with an emission-reception assembly incorporating an electroluminescent diode and phototransistor.

The speed of rotation of the barrel element is controlled in frequency from the time base, the incremental disc making it possible to have an angular reproduction of the position of the laser pencil beam.

Figure 3:
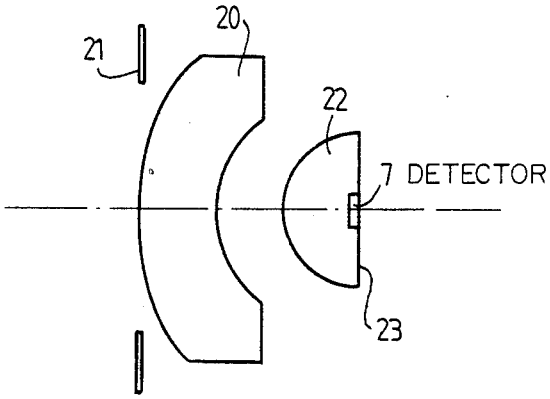
FIG. 3 schematically shows the reception optics of the system.

At reception, reception optics are provided (FIG. 3), comprising a head lens 20, disposed at the level of an entrance pupil 21, and a hemispherical convex plane lens 22, of which the plane face 23 merges with the focal plane. The detector 7 is optically immersed in known manner in the lens 22. In the example in question, this is a detector of HgCdTe type, presenting a maximum of response at 10.6 $\mu$m. A cooler (not shown) is also provided for the detector 7, which is conventional.

Figure 4:
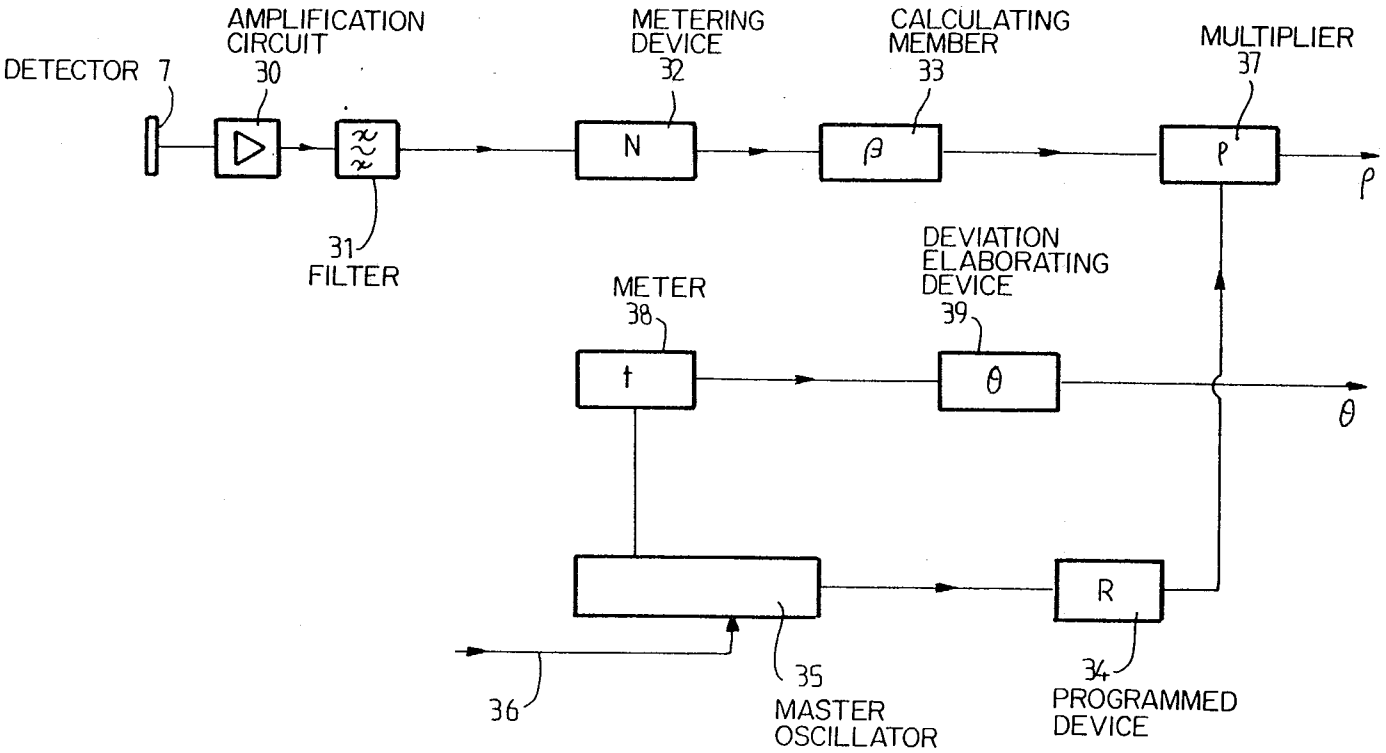
FIG.4 schematically shows the electronic reception circuits of the system.

The electronic reception circuits are shown schematically in FIG. 4.

The signal issuing from the detector 7 is applied to the input of an amplification circuit 30. After amplification, the signal is filtered by a filter 31 centred on the modulation frequency of the laser $$\frac{1}{T_R}.$$

Since a pulsed laser is used, a metering device 32 adds up the pulses received (N). A calculating member 33, connected to the output of the device 32, determines the deviation coordinate $\beta$ by solving the equation $$\beta = \frac{\epsilon}{2} \frac{1}{\sin \pi N \frac{T_R}{T_B}}$$

The metric coordinate $\rho$ is deduced from the equation $$\rho = R\beta$$

R being the distance at which the missile 5 is located.

The distance R is determined at each instant of flight by the law of movement of the missile, in a programmed device 34, triggered off at the departure of the missile 5

$$R = f(t)$$

The input of the device is connected to the output of a master oscillator 35 triggered off by a starting pip delivered by a line 36.

The product of $\beta$ by R is made in the multiplier 37.

A meter 38, whose input is connected to an output of the oscillator 35, measures the duration t which lapses between the instant of passage of the rotating flat pencil beam through a reference position and the instant of passage on the detector 7.

The deviation coordinate $\theta$ which is deduced from the equation:

$$\theta = \frac{2\pi}{T_B} t - 2K\pi,$$

is elaborated in a device 39.

It is the signals delivered by the devices 37, 39 which are applied to the circuit controlling the rudders of the missile.

A source (not shown) for supplying the various elements is, of course, also provided at the level of the receiver.

The interposition of a hemispherical lens and the use of a detector immersed in this improve the balance of linkage of the system, i.e. the signal S to noise B ratio.

In this case, and if the index of the lens is n, it is easy to demonstrate that an entrance pupil with a diameter n times larger may then be used at reception. This may result, in the balance of linkage, in a gain of $n^2$ and, for a given aperture number, an increase in the optical printing, i.e. the distance between the detector and the surface of the nearest reception optics.

Inversely, for a given balance of linkage, the detector may have a detectivity $n^2$ times less. In other words, the detector may be cooled to an intermediate temperature, which brings about a simplification of the cooler. The level of noise B depends in fact on the temperature of the detector. The more the temperature drops, the more B diminishes. If the level of signal S is increased, the level of noise B may therefore also be allowed to increase, and consequently also the temperature of cooling. Cooling is in that case more rapid, which constitutes an appreciable advantage.

We claim:

1. In a system for guiding a missile in a direction of sight, comprising a detector on said missile, said missile also having rudders, a source of emission producing a light beam whose axis corresponds to the direction of sight, means for analyzing the field of observation, adapted to convert the light beam emitted by the source into at least one flat, elongated pencil beam having a width $\epsilon$ and to drive the pencil beam in rotation at a speed $\omega$, about an axis merged with the direction of sight (A'A), to be received by the detector in a time $\tau$, said detector being operable to provide an output signal in response to receipt of said pencil beam, processing means on said missile for determining, from the output signal of the detector, at least one deviation coordinate of the missile with respect to the direction of sight, and operable to control the rudders of the missile in order to control its path on the direction of sight, said processing means being adapted to determine the polar coordinates $(\tau,\theta)$ of the missile with respect to a reference axis (Ox) having an origin (O) located on the axis (A'A) of the pencil beam, the metric coordinate $\rho$ as a function of the speed of rotation $\omega$, of the width $\epsilon$ and of the time of passage $\tau$, and the angular coordinate $\theta$ as a function of time t taken by the pencil beam, during its rotation, to reach the missile, and two master clocks maintained in synchronism are respectively associated with the source of emission and with the detector of the missile.

2. The guiding system of claim 1, wherein a meter is connected to the master clock associated with the detector to measure, at each revolution, the time which lapses between the instant of passage of the pencil beam through a reference position and the instant of passage on the detector.

* * * * *